United States Patent [19]

Ackerman

[11] 4,077,450

[45] Mar. 7, 1978

[54] ROTARY DRUM WASTEWOOD CHIPPER

[75] Inventor: Robert T. Ackerman, Seattle, Wash.

[73] Assignee: Nicholson Manufacturing Company, Seattle, Wash.

[21] Appl. No.: 759,767

[22] Filed: Jan. 17, 1977

Related U.S. Application Data

[63] Continuation of Ser. No. 643,520, Dec. 22, 1975, abandoned.

[51] Int. Cl.[2] ..... B27C 1/00

[52] U.S. Cl. ..... 144/172; 144/42; 144/162 R; 144/230; 144/321; 241/93

[58] Field of Search ..... 144/41, 42, 43, 136 R, 144/162 R, 163, 172, 173, 174, 180, 230, 218, 321; 241/93, 193, 221, 243, 294, 292.1, 296

[56] References Cited

U.S. PATENT DOCUMENTS

| | | | |
|---|---|---|---|
| 817,382 | 4/1906 | Merrill | 144/172 X |
| 2,822,839 | 2/1958 | Frodermann | 144/230 |
| 3,216,470 | 11/1965 | Nilsson | 144/230 |
| 3,545,689 | 12/1970 | Luscombe | 241/243 X |
| 3,762,256 | 10/1973 | Frantz | 241/243 X |
| 3,882,912 | 5/1975 | Sybertz | 144/42 X |

*Primary Examiner*—Harrison L. Hinson
*Assistant Examiner*—W. D. Bray
*Attorney, Agent, or Firm*—Robert W. Beach

[57] ABSTRACT

The periphery of the chipping drum carries one or more axial rows of individual chipping bits in which the bits of adjacent rows are in staggered relationship if there is more than one row, and further carries an evening knife located in a position trailing the row or rows of individual cutting bits. The individual cutting bits are located with reference to ridges of the circumferentially corrugated drum periphery so that each ridge is disposed substantially centrally of a cutting bit. The anvil is corrugated complementally to the chipping drum periphery and is located so that the cutting edges of individual bits move through notches of the anvil. The evening knife moves close to the projections between the anvil notches.

14 Claims, 10 Drawing Figures

ROTARY DRUM WASTEWOOD CHIPPER

This is a continuation of application Ser. No. 643,520, filed Dec. 22, 1975, now abandoned.

BACKGROUND OF THE INVENTION

1. Field of the Invention

The present invention relates to rotary drum chippers for producing chips particularly useful in making pulp and especially for producing such chips from wastewood.

2. Prior Art

The chipper of the present invention is generally of the type shown in Nicholson U.S. Pat. No. 3,661,192, although the chipper of that patent was intended primarily for producing chips from rounds, whereas the chipper of the present invention is intended primarily to produce chips from wastewood. The general combination of an axial row of individual bits and an evening knife is shown in Logan et al. U.S. Pat. No. 3,219,076. In addition, Mitts U.S. Pat. No. 1,209,319 discloses a grooved chipping drum.

SUMMARY OF THE INVENTION

It is a principal object of the present invention to provide a rotary drum chipper which will reliably reduce irregular material to chips irrespective of the attitude in which such material is fed to the chipper.

More specifically it is an object to provide a chipping throat between a chipping drum and an anvil having an undulating passage which will deter movement of appreciably elongated pieces of wood through it without being cut into chips.

Another object is to provide such a chipper which is of rugged construction, yet which can be adjusted to provide close tolerances for most effective operation.

The foregoing objects can be accomplished by utilizing a rotary drum chipper, the drum of which has a circumferentially corrugated periphery cooperating with a corrugated anvil, the position of which anvil is adjustable toward and away from the drum periphery.

DETAILED DESCRIPTION

Figure 1:
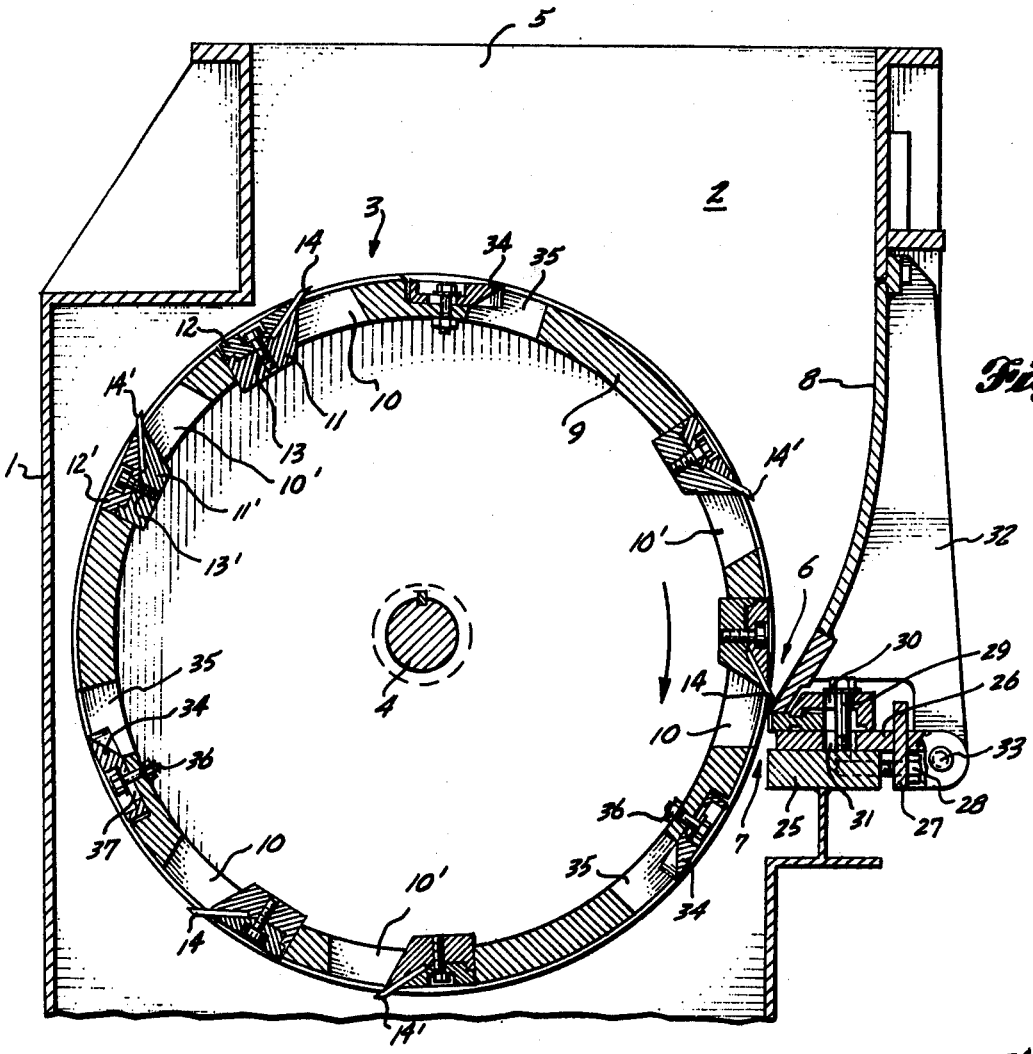
FIG. 1 is a vertical cross section through the chipper taken perpendicular to the axis of the chipping drum.

The rotary drum chipper of the present invention is particularly well adapted to reduce to chips wastewood such as mill ends, that is short pieces of board from cutoff saws, veneer strips, sticks, branches and other wood scraps, although the principle of this chipper is applicable to chippers for chipping rounds. The difficulty with chipping such wastewood in the past has been that large slivers and strips, from a length of a few inches to a few feet, have been able to pass through the chipping throat between the chipping drum and the anvil without being cut transversely of their lengths into short pieces or chips. The construction of the chipper of the present invention deters passage of such elongated woody material through the chipping throat without being cut into short chips or pieces suitable for use in making pulp.

The general construction of the chipper is similar to that of the chipper shown in U.S. Pat. No. 3,661,192, including a hollow chipper body 1, the interior of which forms a chipping chamber 2. In this chamber a cylindrical chipping drum 3 is rotatively mounted by a horizontal shaft 4. Woody material stock to be chipped is supplied to the upper portion of the chipping chamber 2 through a feed opening 5. As such material falls onto the periphery of the drum 3, it is carried by the drum rotating in the direction of the arrow into a chipping throat 6 between the periphery of the drum 3 and the anvil assembly 7. Rotation of the drum feeds the wastewood into the downwardly convergent passage between the periphery of the drum 3 and the upright wall 8 of the chipping chamber.

In the peripheral shell 9 of the chipping drum are apertures serving as sockets for the chipping bit mounting structure. As shown best in FIG. 2, such apertures are arranged in adjacent axial rows 10 and 10', although a single axial row could be used. The row of apertures 10 is located at the leading side of the row of apertures 10', and, conversely, the row of apertures 10' is located at the trailing side of the row of apertures 10 in the direction of rotation of the chipping drum 3. Each of such apertures 10 and 10' constitutes a socket in which an individual chipper bit is mounted.

A preferred type of chipper bit and bit-holding blocks are shown in U.S. Pat. No. 3,757,839 and U.S. Pat. No. 3,892,265. Inner bit-clamping blocks 11 are secured, respectively, such as by welding, in the several drum shell apertures 10, and similar inner clamping blocks 11' are secured respectively in the several drum shell apertures 10'. Outer clamping blocks 12 are securable to the inner clamping blocks 11 by bolts 13, and outer clamping blocks 12' are secured to inner clamping blocks 11' by bolts 13'. Cutting bits 14 are clamped between blocks 11 and 12 by tightening bolts 13 and bits 14' are clamped between blocks 11' and 12' by tightening bolts 13'.

Figure 2:
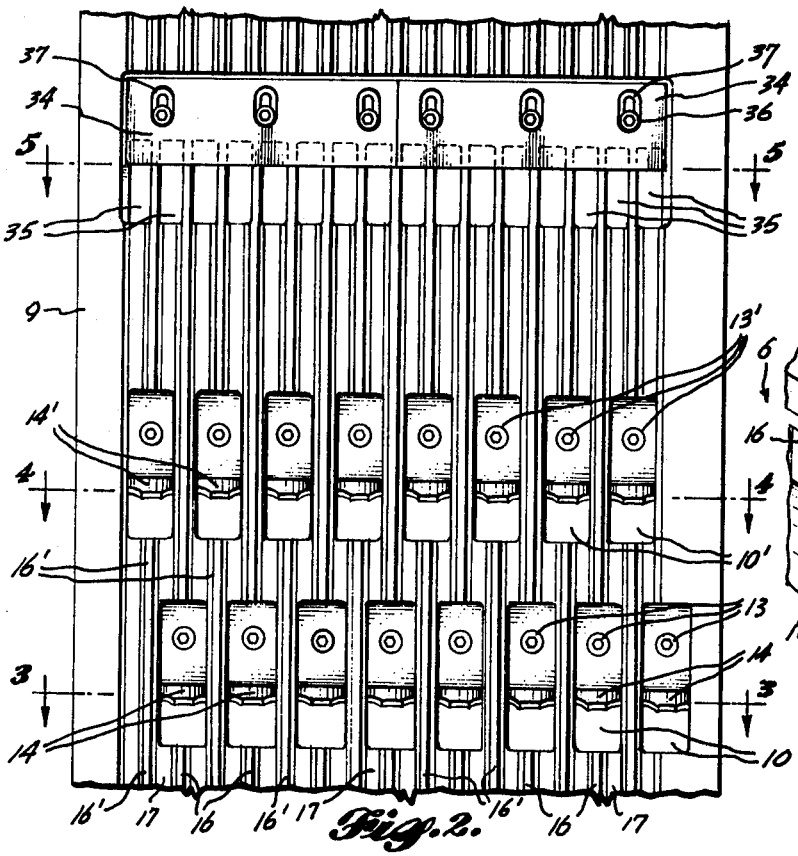
FIG. 2 is a developed elevation of the drum periphery.
Figure 6:
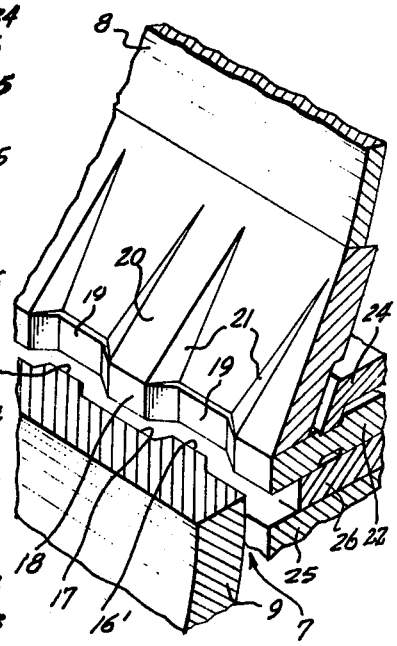
FIG. 6 is an enlarged detail top perspective of a fragmentary portion of the drum periphery and the anvil at the location of the chipping throat.

FIG. 2 shows that the individual cutting bits 14 in one axial row are located in staggered relationship relative to the individual cutting bits 14' in the adjacent axial row of cutting bits. Such staggered relationship is illustrated as the cutting bits 14' being shifted relative to the cutting bits 14 a distance axially equal to one-half the spacing between the adjacent cutting bits 14 in the leading row. Stated in another way, with the exception of the bit at the right end of the leading row and the bit at the left end of the trailing row, each of the bits 14 of the leading row is located midway between bits 14' of the trailing row and conversely, of course, each of the bits 14' of the trailing row is located midway between bits 14 of the leading row.

The shell 9 of the chipping drum 3 has circumferentially extending corrugations. These corrugations include ridges 16 spaced apart axially of the drum distances substantially corresponding to the spacing of the centers of the cutting bits 14 in the leading row. Moreover, such ridges are located so that a ridge 16 is disposed in substantially central alignment with each cutting bit 14. Midway between each pair of adjacent ridges 16 is a ridge 16', and each such ridge is disposed in substantially central alignment with a cutting bit 14' in the trailing row of cutting bits.

Between the adjacent ribs 16 and 16' are grooves 17, as indicated in FIGS. 2 to 6, inclusive. Preferably such grooves are of isosceles trapezoidal cross section, as shown, although the grooves could be square grooves. The width of the flat bottom of each groove 17 exceeds the width of the flat top of each ridge 16 and 16' by a distance approximately equal to twice the depth of such groove. As shown in FIG. 2, the ridges and grooves are interrupted circumferentially of the drum by the apertures 10 and 10' in which the individual cutting bits are mounted. The cutting bits are shown as being mounted in the trailing portions of the apertures so that the chips cut by the individual cutting bits can pass through the forward portions of the respective apertures 10 and 10' into the interior of the drum 3.

The anvil assembly 7 has a corrugated profile generally matching the cross section of the corrugated drum periphery and the anvil is positioned relative to the drum periphery so as to form a chipping throat of undulating shape. Such anvil assembly includes projections 18 and intervening notches 19 that are arranged in matching relationship to the ridges and grooves of the corrugated drum periphery. Such notches are preferably of isosceles trapezoidal cross section, and preferably are of a cross section substantially like the cross section of the drum grooves 17. As shown best in FIGS. 3 and 4, the corrugated drum periphery and the corrugated profile of the anvil assembly are spaced apart to form between them the chipping throat 6 of undulating shape.

In order to prevent wastewood to be chipped from being driven onto a flat surface disposed generally radially of the drum by rotation of the drum periphery toward the chipping throat, the surfaces of the anvil assembly at the entrance to the chipping throat are inclined relative to the corrugated profile of the anvil assembly. For this purpose ribs 20 taper in thickness from the anvil projections 18 upward along the chipping chamber side 8, as shown best in FIG. 6. The upright edges of such projections merge with the grooves 21 between such projections, which grooves flare upwardly away from the notches 19 of the corrugated anvil profile.

In order to be able to vary the width of the undulating chipping throat 6 and to reshape the anvil profile from time to time as may be necessary, it is preferred that the corrugated profile of the anvil be provided on the edge of an anvil throat plate 22 extending generally radially of the drum and mounted for adjustment of its corrugated edge toward and away from its drum periphery. Such anvil throat plate is shown in FIGS. 1, 6, 7 and 9 as having at least one, and preferably two opposite anchoring grooves 23 engageable by the toe of a throat plate clamping bar 24. Provision of two anchoring grooves enables the throat plate to be reversed side for side to equalize wear.

Figure 7:
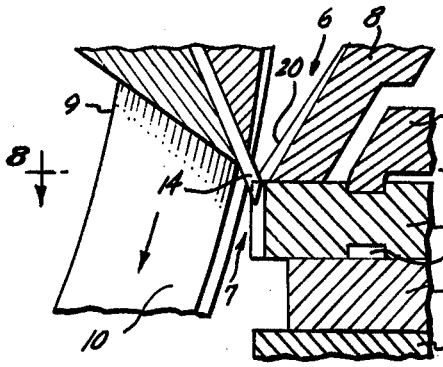
FIG. 7 is an enlarged detail section through a fragmentary portion of the chipping throat.
Figure 9:
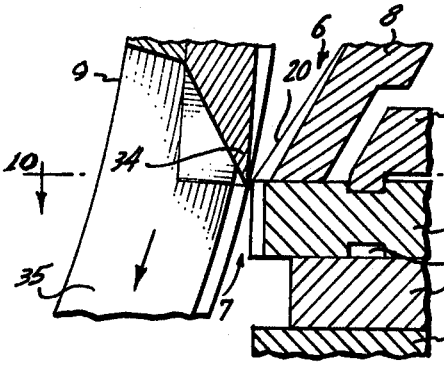
FIG. 9 is an enlarged detail cross section through another portion of the chipping throat.
Figure 8:
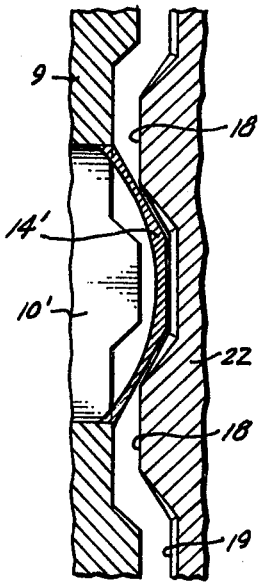
FIG. 8 is a section through such portion of the chipping throat taken along line 8—8 of FIG. 7.

The throat plate 22 is supported from an anvil assembly supporting platform 25 located a short distance below the chipping throat, as shown in FIGS. 1, 7 and 9. While the throat plate could rest directly on the platform, it is preferred that the throat plate rest on an intermediate plate 26 which is slidable edgewise horizontally toward and away from the drum 3. Such slidable plate can be held in any desired adjusted position by an upright retaining bar 27 extending through a slot in plate 26 and anchored to the support platform 25 by a horizontal bolt 28.

The throat plate clamping bar 24 can be held down relative to the anvil assembly support platform 25 by a vertical bolt 29 extending through a slot 30 in the clamping bar 24 and a slot 31 in the slidable plate 26. Bolt 29 passes behind the throat plate 22, as shown in FIG. 1. The support platform 25 has a tapped hole in its upper side to receive the threaded lower end of bolt 29. Tightening of such bolt will, therefore, draw clamping bar 24 down against the throat plate 22 and the slidable plate 26 to anchor both of these plates securely to the support platform.

In order to obtain easy access to the anvil assembly 7, the wall section 8 is constructed as a door. The plate forming such wall section is stiffened by mounting flanges 32 which are connected by pivots 33 to the slidable plate 26, as shown in FIG. 1. The ribs 20 are formed on the lower edge of the wall section 8, and such ribs can be moved toward or away from the periphery of the drum 3 by sliding toward or away from the drum plate 26, which carries the door hinge 33. The slots 31 in clamping bar 24 and plate 26 enable the relative positions of the chipping throat projections 18 and the ribs 20 to be altered so that the ends of such ribs will be flush with the projections 18.

Figure 10:
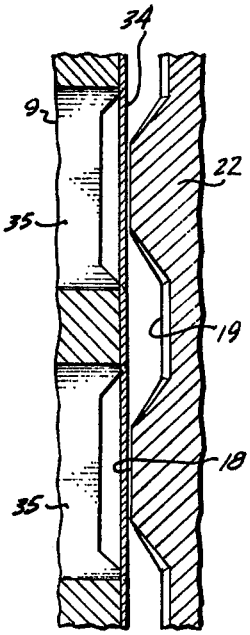
FIG. 10 is a section through the same portion of the chipping throat taken on line 10—10 of FIG. 9.

In addition to the individual cutting bits 14 and 14', evening knives 34 elongated axially of the drum are mounted on the periphery of the drum between rows of the individual cutting bits. Such evening knives are mounted in sockets 35 in the drum shell 9 by bolts 36 passing through slots 37 in such knives. The cutting ends of the bits 14 and 14' project beyond the periphery of the drum 3 considerably farther than the cutting edge of the evening knife 34 which extends axially of the drum, as shown by a comparison of FIGS. 7 and 9. This arrangement is possible because the projecting ends of the cutting bits 14 and 14' can sweep through the notches 19 of the anvil, as shown in FIG. 7, while the cutting edge of the evening knife 34 must clear the projections 18 of the anvil, as shown in FIGS. 9 and 10.

Figure 3:
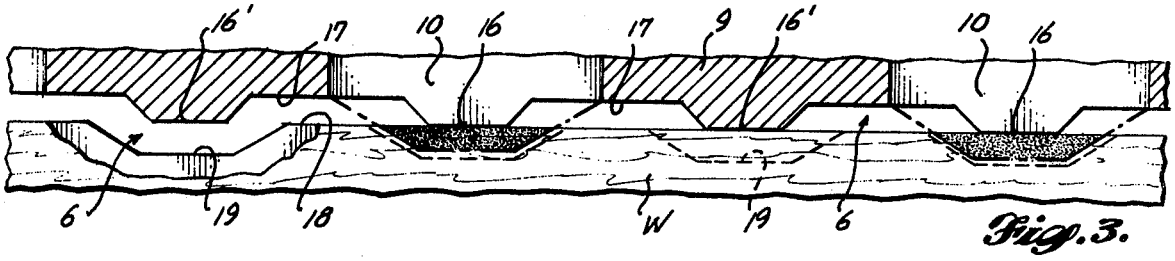
FIGS. 3, 4 and 5 are fragmentary enlarged detail cross sections of portions of the drum periphery and the cooperating anvil taken on lines 3—3, 4—4 and 5—5, respectively, of FIG. 2.
Figure 4:
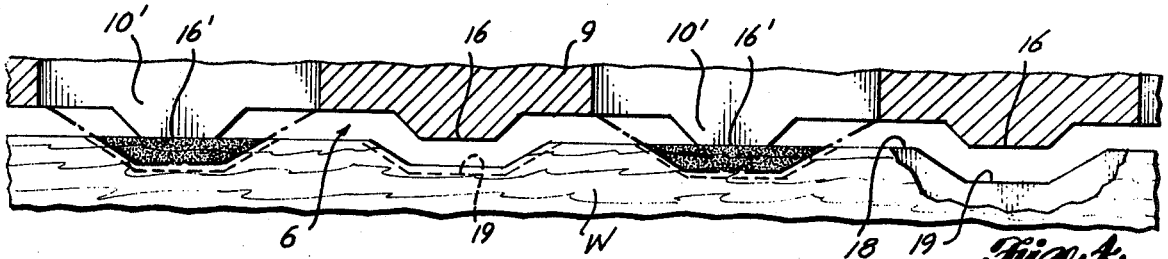
Figure 5:
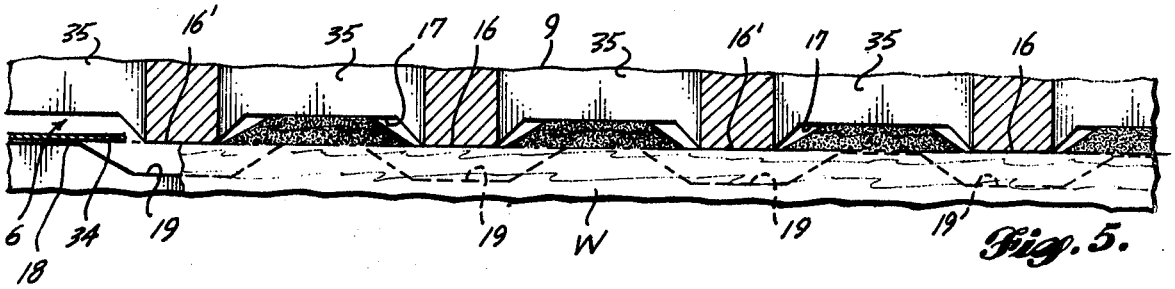

FIGS. 3, 4 and 5 illustrate generally the operation of the chipper. An elongated piece of wastewood W, such as a scrap strip of veneer, would be drawn down into the converging entrance to the chipping throat shown in FIG. 1 by rotation of drum 3 with an edge of such veneer pressed against the ridges 16 and 16' of the drum. As the cutting bits 14 in one axial row pass the anvil, chips will be cut out of the edge of the strip, as shown by the stippled portions in FIG. 3. As the following bits 14' pass the anvil, they will cut out of the veneer additional chips, as shown by the stippled areas in FIG. 4. At this point the stippled areas shown in FIGS. 5 can move toward the drum so that they are received in the drum grooves 17. As the evening knife 34 passes the anvil, as illustrated in FIG. 5, the projecting portions of the wastewood strip received in the drum grooves 17 will be cut off evenly so that the edge of the strip is restored to linear condition.

As the next rows of cutting bits 14 and 14' pass the anvil, notches again will be cut in the new edge of the wastewood strip so that the intermediate portions again can move into the grooves 17 of the chipping drum, as shown in FIG. 5. Such projections will then be cut off evenly by the next following evening knife 34. This operation continues until the entire strip W has been cut into chips.

I claim:

1. In a chipper including a chipping chamber, a chipping drum rotatably mounted in the chipping chamber and having an axial row of individual cutting bits and an anvil mounted in the chipping chamber adjacent to the periphery of the drum and cooperating with the individual cutting bits to form a chipping throat, the chipping drum having a periphery circumferentially corrugated to provide alternate ridges and grooves, the anvil being corrugated at the chipping throat with projections and notches generally complemental to the grooves and ridges of the corrugations of the chipping drum periphery and the corrugations of the chipping drum periphery and of the anvil being disposed in interfitting relationship, the improvement comprising an elongated evening knife having its length extending axially of the drum in a position trailing the row of individual cutting bits circumferentially in the direction of rotation of the drum, and means mounting said evening knife on the chipping drum with its cutting edge located to pass closely adjacent to the projections of the corrugate anvil as the drum is rotated.

2. In the chipper defined in claim 1, each individual chipping bit being located so that a ridge of the chipping drum corrugated periphery is disposed in substantially central alignment with each such cutting bit.

3. In the chipper defined in claim 1, individual cutting bits in the axial row being located so that their centers are spaced apart a distance substantially equal to the spacing between the centers of ridges of the chipping drum corrugated periphery.

4. In the chipper defined in claim 1, the chipping drum having a plurality of axial rows of individual cutting bits arranged in sequence circumferentially of the drum, the cutting bits in one row being staggered relative to the cutting bits in an adjacent row, and the elongated evening knife being in a position trailing the plurality of rows of individual cutting bits circumferentially in the direction of rotation of the drum.

5. In the chipper defined in claim 4, the central portions of adjacent individual cutting bits in an axial row being spaced apart a distance substantially equal to an integer multiple of the pitch of the ridges of the chipping drum corrugated periphery.

6. In the chipper defined in claim 5, the central portions of adjacent individual cutting bits in an axial row being spaced apart a distance equal to twice the pitch of the ridges of the chipping drum corrugated periphery.

7. In the chipper defined in claim 4, the cutting bits in one axial row being disposed respectively substantially centrally between the cutting bits of an adjacent row.

8. In the chipper defined in claim 1, the corrugations of the chipping drum periphery and the corrugations of the anvil having substantially the same cross-sectional profile.

9. In the chipper defined in claim 1, means mounting the individual cutting bits on the chipping drum with their cutting edges projecting beyond the periphery of such chipping drum at locations corresponding to notches of the corrugated anvil.

10. In the chipper defined in claim 9, the profile of a cutting end of a cutting bit being substantially complemental to the contour of the corrugated anvil notch through which such cutting edge is moved by rotation of the chipping drum.

11. In the chipper defined in claim 1, the grooves of the chipping drum corrugated periphery being of isosceles trapezoidal cross section.

12. In the chipper defined in claim 1, the notches of the corrugated anvil being of isosceles trapezoidal cross section.

13. In the chipper defined in claim 11, the grooves of the chipping drum corrugated periphery and the notches of the corrugated anvil being of substantially identical isosceles trapezoidal cross section.

14. In a chipper including a chipping chamber, a chipping drum rotatably mounted in the chipping chamber and having an axial row of individual cutting bits, and an anvil mounted in the chipping chamber adjacent to the periphery of the drum and cooperating with the individual cutting bits to form a chipping throat, the chipping drum having a periphery circumferentially corrugated to provide alternate ridges and grooves, the anvil being corrugated at the chipping throat with projections and notches generally complemental to the grooves and ridges of the corrugations of the chipping drum periphery, and the corrugations of the chipping drum periphery and of the anvil being disposed in matching relationship, the improvement comprising the anvil further defining grooves merging with said notches at the chipping throat and flaring away from said notches.

* * * * *